United States Patent [19]

Burridge et al.

[11] Patent Number: 4,848,491

[45] Date of Patent: Jul. 18, 1989

[54] ROTARY DRILL BITS

[75] Inventors: Paul S. Burridge, Stroud; Michael T. Wardley, Lymm, both of England

[73] Assignee: Reed Tool Company Limited, Northern Ireland

[21] Appl. No.: 122,897

[22] Filed: Nov. 19, 1987

[30] Foreign Application Priority Data

Nov. 22, 1986 [GB] United Kingdom ..... 8628168

[51] Int. Cl.[4] ..... E21B 10/60

[52] U.S. Cl. ..... 175/329; 175/377; 175/393

[58] Field of Search ..... 175/329, 336, 339, 340, 175/377, 393, 415

[56] References Cited

U.S. PATENT DOCUMENTS

| | | | |
|---|---|---|---|
| 3,951,220 | 4/1976 | Phillips, Jr. et al. | 175/393 |
| 4,022,286 | 5/1977 | Gill | 175/393 X |
| 4,733,735 | 3/1988 | Barr et al. | 175/393 |

*Primary Examiner*—William P. Neuder

*Attorney, Agent, or Firm*—Browning, Bushman, Zamecki & Anderson

[57] ABSTRACT

A drill bit for drilling deep holes in subsurface formations comprises a bit body having a generally hemispherical leading face and a gauge region, and two blades each extending spirally outwardly across the leading face of the bit body away from the axis of rotation, a cavity of substantial peripheral and axial extent being formed in the bit body on the forward side of each blade, and communicating with an associated exit channel in the gauge region. A plurality of cutting elements are mounted along each blade, the cutting elements being mounted closely adjacent one another side-by-side along the blade so that their cutting edges together form a single long cutting edge without substantial discontinuities. A passage in the bit body supplies drilling fluid to nozzles in the cavities for cooling and cleaning the cutting elements, fluid from the nozzles sweeping past the cutting elements and out through the exit channels.

9 Claims, 1 Drawing Sheet

ROTARY DRILL BITS

BACKGROUND OF THE INVENTION

The invention relates to rotary drill bits for use in drilling deep holes in subsurface formations.

In particular, the invention relates to drill bits of the kind comprising a bit body having a leading face and a gauge region, a number of blades each extending across the leading face of the bit body, a plurality of cutting elements mounted along each blade, a number of openings in the bit body, a passage in the bit body for supplying drilling fluid to said openings for cooling and cleaning the cutting elements, and at least one exit channel in the gauge region of the bit body.

The present invention sets out to provide improved constructions of drill bit of this basic type.

SUMMARY OF THE INVENTION

According to one aspect of the invention, in a drill bit of the above kind, the cutting elements along each blade comprise a plurality of discrete cutting elements mounted closely adjacent one another side-by-side along the blade so that the cutting edges thereof together form a single long cutting edge without substantial discontinuities therein.

Each blade may have an outer surface which, in use, faces the surface of the formation being drilled and a front surface facing in the direction of normal forward rotation of the bit, and in this case said cutting elements may be mounted along the junction between said outer and front surfaces of each blade. Each cutting element may comprise a tablet at least the front cutting face of which is formed from polycrystalline diamond material. For example, each cutting element may comprise a front cutting layer of polycrystalline diamond material, or other superhard material bonded to a backing layer of less hard material, such as tungsten carbide. Each cutting element may be mounted directly on the material of the bit body or on a carrier received within a socket in the blade.

Each cutting element may have a substantially straight cutting edge, the cutting elements being so shaped that they may be mounted side-by-side along the blade with the straight cutting edges thereof extending end-to-end, without substantial discontinuities at the junctions between adjacent cutting edges, to form said single long cutting edge. In one particular embodiment according to the invention the cutting elements are generally semi-circular in configuration, the diametral edge of each cutting element constituting its cutting edge.

According to a second aspect of the invention, a drill bit of the kind first referred to is characterised in that each blade extends generally spirally outwardly away from the axis of rotation of the bit body to the gauge region, and a cavity of substantial peripheral and axial extent is formed in the bit body on the forward side of each blade, at least one of said openings for drilling fluid being located in each cavity.

In a preferred embodiment of the invention there are provided two spiralling blades and cavities, symmetrically arranged with respect to the axis if rotation of the bit.

Preferably said opening in each cavity is disposed adjacent the central axis of rotation of the bit body, and is directed along said blade, or in a direction having a substantial component along said blade. An exit channel in the gauge region may form a smooth continuation of each said cavity.

In one embodiment according to the invention the leading face of the bit body is substantially hemispherical.

Each opening is also preferably located inwardly beyond the innermost cutting element on the associated blade, whereby the flow of drilling fluid from the opening sweeps past all the cutting elements on the blade.

DETAILED DESCRIPTION OF THE PREFERRED EMBODIMENT

Figure 1:
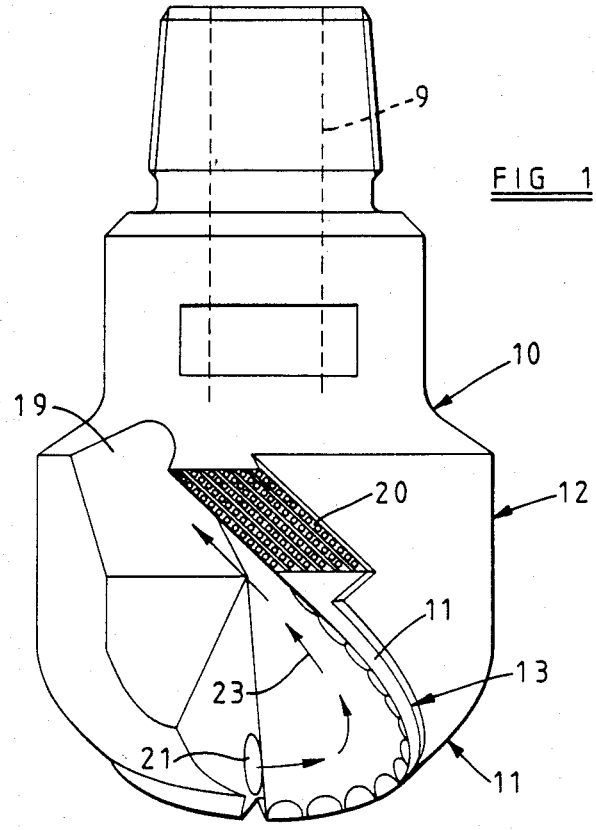
FIG. 1 is a side elevation of a drill bit.
Figure 2:
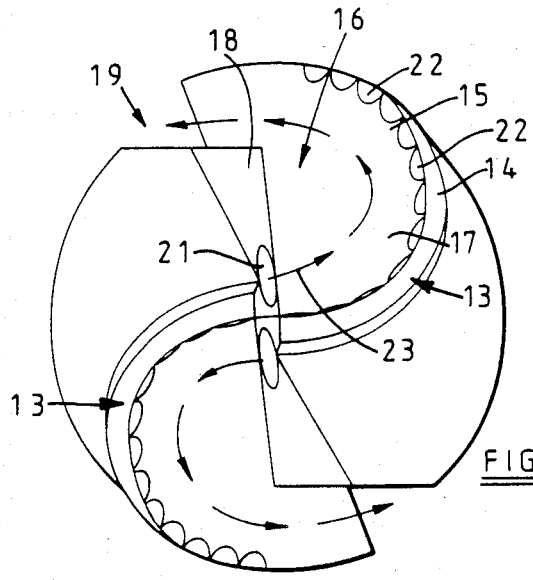
FIG. 2 is an end view of the bit shown in FIG. 1.

The rotary drill bit shown in the drawings is suitable for use in drilling deep holes in subsurface formations and comprises a bit body 10 having a leading face 11, which is generally hemispherical in contour, and a gauge region 12. The bit body may be machined from steel or moulded using a powder metallurgy process.

The leading face of the bit body is integrally formed with two upstanding blades 13 which are symmetrically disposed with respect to the central axis of rotation of the bit and spiral outwardly from the axis of rotation to the gauge region. Each blade has an outer surface 14 which, in use of the bit, faces the surface of the formation being drilled, and a front surface 15 facing generally in the direction of normal forward rotation of the bit.

The bit body is formed with a cavity 16 of substantial peripheral and radial extent in the front of each blade 13. The cavity is substantially wider and greater in volume than the comparatively narrow channels which are often employed in drill bits to direct the flow of drilling fluid along the cutting elements mounted on the blades. In the present case each cavity 16 is bounded by a smoothly and concavely curved wall 17 which forms a smooth continuation of the front surface 15 of each blade, and a flat opposite wall 18.

The outer periphery of each cavity 16 leads smoothly into an exit channel 19 formed in the gauge region. Forming a continuation of each blade 13 across the gauge region is a kicker 20 on which are mounted rows of abrasion elements, for example natural diamonds.

Mounted along each blade 13 are a plurality of cutting elements 22. Each cutting element is in the form of a generally semi-circular tablet comprising a front layer of polycrystalline diamond or other superhard material bonded to a backing layer of less hard material, such as tungsten carbide. Alternatively, the cutting elements might be of the kind comprising a unitary body of thermally stable polycrystalline diamond material. The cutting elements may be mounted directly on the blade material of the bit body or may be mounted on carriers which are similarly shaped in cross-section to the cutting elements and are received in sockets in the blades.

The cutting elements 22 are so mounted that the front cutting surface of each element lies substantially flush with the front surface 15 of the blade and the surface 17 of the cavity 16. The cutting elements are closely located side-by-side along each blade 13 so that the diametral cutting edges of the cutting elements form in effect a continuous long cutting edge without substantial discontinuities. That is to say, the end of each cutting edge is at substantially the same level as the adjacent end of the cutting edge on an adjacent cutting element so that there is no "step" formed between adjacent cutting elements, and any gap between adjacent cutting elements along the blade is of negligible width. For example, in a case where the length of the cutting edge is about 24 mm any gap between adjacent cutting edges should preferably be no greater than 3 mm.

A nozzle for drilling fluid, indicated diagrammatically at 21, is mounted in the wall 18 of each cavity and faces in a direction generally along the associated blade 13. Each nozzle 21 communicates with a central passage 9 in the bit body through which drilling fluid is delivered under pressure.

The nozzles 21 are so directed that drilling fluid emerging under pressure from the nozzles flows around the cavity 16 and through the associated exit channel 19 as indicated by the arrows 23.

As will be seen from the drawings, each nozzle 21 is located inwardly beyond the innermost cutting element 22 on the associated blade, so that all the flow of drilling fluid from the nozzle sweeps past all the cutting elements on the blade.

In the arrangement shown each nozzle 21, as may best be seen in FIG. 1, is so directed that the drilling fluid flows directly along the front cutting surfaces of the cutting elements 22 and will not therefore impact on the surface of the formation being drilled to any significant extent, at least until a significant distance after it has emerged from the nozzle. However, the nozzles 21 might also be directed so that the jet of drilling fluid impacts on the formation much closer to the central axis of rotation of the drill bit, so that the flow from the nozzle has a component along each blade 13. For example, the nozzles may be so directed that the jet impacts on the surface of the formation close to the central axis of rotation of the drill bit and at a shallow angle, e.g. less than 45°, to the surface of the formation.

In the drawings the drilling fluid flowing through the cavities 16 is shown as all passing directly to the annulus through the associated exit channel 19. In practice, however, a proportion of the drilling fluid flowing outwardly along each cavity 16 may be recirculated in the cavity due to the setting up of a vortex flow in the cavity. It will be appreciated that the formation of a vortex may be enhanced by suitably shaping the surface 18, particularly where it meets the exit channel 19.

I claim:

1. A drill bit rotatable about an axis, comprising:

a bit body having a leading face, a gauge region, and a drilling fluid passage;

a plurality of blades each extending spirally outwardly across the leading face of the bit body and away from the axis of rotation to the gauge region, each of the plurality of blades having a front surface;

the bit body forming a plurality of cavities each having a substantial peripheral and axial extent being formed in the bit body on the forward side of a respective blade;

a plurality of discrete cutting elements, each having a substantially straight cutting edge and disposed side by side closely adjacent one another alone each of the plurality of blades such that the straight cutting edges of adjacent cutting elements are in line along each blade and form a single long cutting edge without substantial discontinuities between adjacent cutting elements; and the bit body defining a plurality of nozzle openings for fluid communication from the drilling fluid passage to a respective one of the plurality of cavities, and defining an exit channel from each of the plurality of cavities for cooling and cleaning of the plurality of cutting elements.

2. A drill bit according to claim 1, further comprising:

each of the plurality of blades has an outer surface which, in use, faces the surface of the formation being drilled; and each of the plurality of cutting elements is mounted along a junction between the outer surface and the front surface along a respective one of the plurality of blades.

3. A drill bit according to claim 1, wherein each of the plurality of cutting elements comprises a tablet having a front cutting face formed from polycrystalline diamond material.

4. A drill bit according to claim 1, wherein each of the plurality of cutting elements is generally semi-circular in configuration and its straight cutting edge is a diametrical edge.

5. A drill bit according to claim 1, wherein the plurality of blades consists of two spiralling blades symmetrically arranged with respect to the axis of rotation of the drill bit.

6. A drill bit according to claim 1, wherein each of the nozzle openings is disposed adjacent the axis of rotation of the drill bit and is directed substantially along a respective one of the blades.

7. A drill bit according to claim 1, wherein each of the exit channels is provided in the gauge region of the bit body and forms a smooth continuation of a respective cavity.

8. A drill bit according to claim 1, wherein the face of the bit body has a substantially hemispherical configuration.

9. A drill bit according to claim 1, wherein each each of the nozzle openings is located radially inwardly of an innermost cutting element on a respective blade, such that drilling fluid from end of the nozzle openings sweeps past the plurality of cutting elements on the respective blade.

* * * * *